United States Patent [19]

Whiting et al.

[11] Patent Number: 4,938,842

[45] Date of Patent: Jul. 3, 1990

[54] HIGH CONSISTENCY PEROXIDE BLEACHING

[75] Inventors: Philip Whiting, Milton; Adele M. Rhodes, Oakville; Arnold E. Willoughby, Mississauga; Martin G. Fairbank, Milton; Hollis D. MacEwen, Mississauga; Fraser McLellan, Campbellville, all of Canada

[73] Assignee: Abitibi-Price Inc., Toronto, Canada

[21] Appl. No.: 392,626

[22] Filed: Feb. 23, 1989

Related U.S. Application Data

[63] Continuation of Ser. No. 87,488, Aug. 20, 1987, abandoned.

[30] Foreign Application Priority Data

Aug. 20, 1986 [GB] United Kingdom ..... 8620222

[51] Int. Cl.[5] ..... D21B 1/16; D21D 1/20

[52] U.S. Cl. ..... 162/78; 162/26; 162/37; 162/56; 162/72; 162/80; 162/82

[58] Field of Search ..... 162/78, 72, 83, 24–26, 162/28, 37, 40, 18, 19, 80, 82, 56

[56] References Cited

U.S. PATENT DOCUMENTS 4,294,653 10/1981 Lindahl et al. ..... 162/78 X 4,599,138 7/1986 Lindahl ..... 162/84 X

*Primary Examiner*—Peter Chin

*Assistant Examiner*—Thi Dang

*Attorney, Agent, or Firm*—Arne I. Fors

[57] ABSTRACT

A process is provided for the bleaching of wood pulp with hydrogen or sodium peroxide. The process includes the steps of adding to a wood pulp a bleach liquor having an effective amount of hydrogen or sodium peroxide bleaching agent and, by weight of the diluted wood pulp, 0.5 to 6% sodium hydroxide, 0 to 5% sodium silicate, 0 to 1%, preferably 0.02 to 0.05%, magnesium sulphate, and a chelating agent in an amount sufficient to sequester heavy metal ions in the pulp, to produce a pulp consistency of 1 to 16% at a temperature in the range of the bleach liquor freezing point to 25° C., uniformly mixing the bleach liquor with the wood pulp, and immediately thickening the diluted wood pulp to a consistency in the range of 20 to 70% for bleaching of the thickened wood pulp. The wood pulp can be subjected to a preliminary treatment by the addition of a chelating agent in an amount sufficient to sequester chelatable heavy metals including manganese at a pulp consistency of 1 to 10%, and dewatering said pulp to a consistency of 20 to 70% to remove the sequestered manganese to less than 10 ppm.

11 Claims, 4 Drawing Sheets

HIGH CONSISTENCY PEROXIDE BLEACHING

This application is a continuation of application Ser. No. 087,488 filed Aug. 20, 1987 (now abandoned).

BACKGROUND OF THE INVENTION

This invention relates to the bleaching of wood pulp and, more particularly, relates to an improvement in the bleaching of wood pulp with hydrogen or sodium peroxide. The term "bleaching" used herein refers to the brightening of wood pulp by decolorization. All brightnesses reported herein were measured using a TECHNIBRITE TM brightness meter.

Conventional peroxide bleaching of wood pulp is done at consistencies ranging from 10 to 25%. The bleach liquor is mixed directly with the pulp in mixers requiring a large energy input. The consistency is usually kept as high as possible since it has been found that the higher the consistency the higher the brightness gain, at least up to 35% in the laboratory. However, when the consistency is raised above about 25% in the mill it becomes very difficult to achieve proper mixing of the liquor with the pulp and bleaching efficiency accordingly either levels off or decreases. It is stated by Andrews and Singh in The Bleaching of Pulp by Tappi Press (third edition), that the improvement in brightness between 12% and 25% consistency amounted to only one brightness point.

In 1968 Nardi and Adami received Canadian patent No. 798,620 which discloses a process in which pulp is fragmented in a gaseous environment at consistencies above 30%. Atomized bleach liquor is then sprayed into the pulp to achieve uniform mixing. However, this technology has not been applied commercially.

Lindahl et al. U.S. Pat. No. 4,160,693 granted July 10, 1979 discloses a process for the bleaching of cellulose pulp in which inter alia bleach liquor is mixed with pulp having a reduced consistency at a temperature within the temperature range of 30° to 105° C.

The major difficulty with high consistency peroxide bleaching has always been mixing the liquor with the pulp. When mixing is poor, non-uniform bleaching results, and the final brightness gain is less than anticipated. This results in a practical maximum bleaching consistency of about 25% and, as a consequence, also necessitates higher chemical costs for uniform peroxide bleaching.

STATEMENT OF THE INVENTION

In accordance with the method of the present invention, the problem of mixing at high consistency is negated by eliminating this difficult step. The bleach liquor is first mixed with the pulp at low consistency (1–16%), where excellent mixing is easy to achieve, at a temperature in the range of the freezing point of the bleach liquor to 25° C., a minimum temperature being preferred. The pulp is then quickly thickened, for example by pressing, to the desired bleaching consistency in the range of 20 to 70%, preferably at a higher consistency level. The concentration of chemicals in the bleach liquor is adjusted such that when the desired final consistency is reached the proper amounts of chemicals remain with the pulp. The thickened pulp is then retained for the desired amount of time, 1 minute to 24 hours at the desired temperature in the range of 95 to 10° C. The excess bleach liquor, which was removed from the pulp during the thickening stage, is replenished with additional chemicals, cooled and recycled for preliminary mixing with pulp feed as necessary at low consistency.

In accordance with a preferred embodiment of the process of the invention for bleaching wood pulp, the process comprises the steps of adding to the wood pulp a bleach liquor having an effective amount of hydrogen or sodium peroxide bleaching agent and, by weight of the diluted wood pulp 0.5 to 6% sodium hydroxide, 0 to 5% sodium silicate, 0 to 1%, preferably 0.02 to 0.05% magnesium sulphate, and an effective amount, preferably from 0 to 0.5% of a chelating agent, to produce a pulp consistency of 1 to 16% at a temperature in the range of the bleach liquor freezing point to 25° C., uniformly mixing the bleach liquor with the wood pulp, and immediately thickening the diluted wood pulp to a consistency in the range of 20 to 70% for bleaching of the thickened wood pulp. It is important for the successful conduct of the process of the invention that the temperature of the bleach liquor and the temperature of the liquor/pulp mixture is kept as low as possible to minimize peroxide decomposition and to slow the rate of peroxide reaction with the pulp.

In another embodiment of the said process, the wood pulp is subjected to a preliminary treatment by the addition of a chelating agent in an amount sufficient to sequester chelatable heavy metals including manganese at a pulp consistency of 1 to 10%, and dewatering said pulp to a consistency of 20 to 70% to remove the sequestered manganese to less than 10 ppm, preferably as low as possible.

The liquor produced by thickening of the diluted wood pulp is re-fortified with chemicals, cooled and recycled for addition to wood pulp feed. Bleaching of the thickened wood pulp occurs at a temperature in the range of 10 to 95° C., preferably at a temperature in the range of 50 to 80° C. for a time sufficient to achieve the desired brightness.

BRIEF DESCRIPTION OF THE DRAWINGS

The process of the invention will now be described with reference to the accompanying drawings, in which.

DESCRIPTION OF THE PREFERRED EMBODIMENTS

Figure 1:
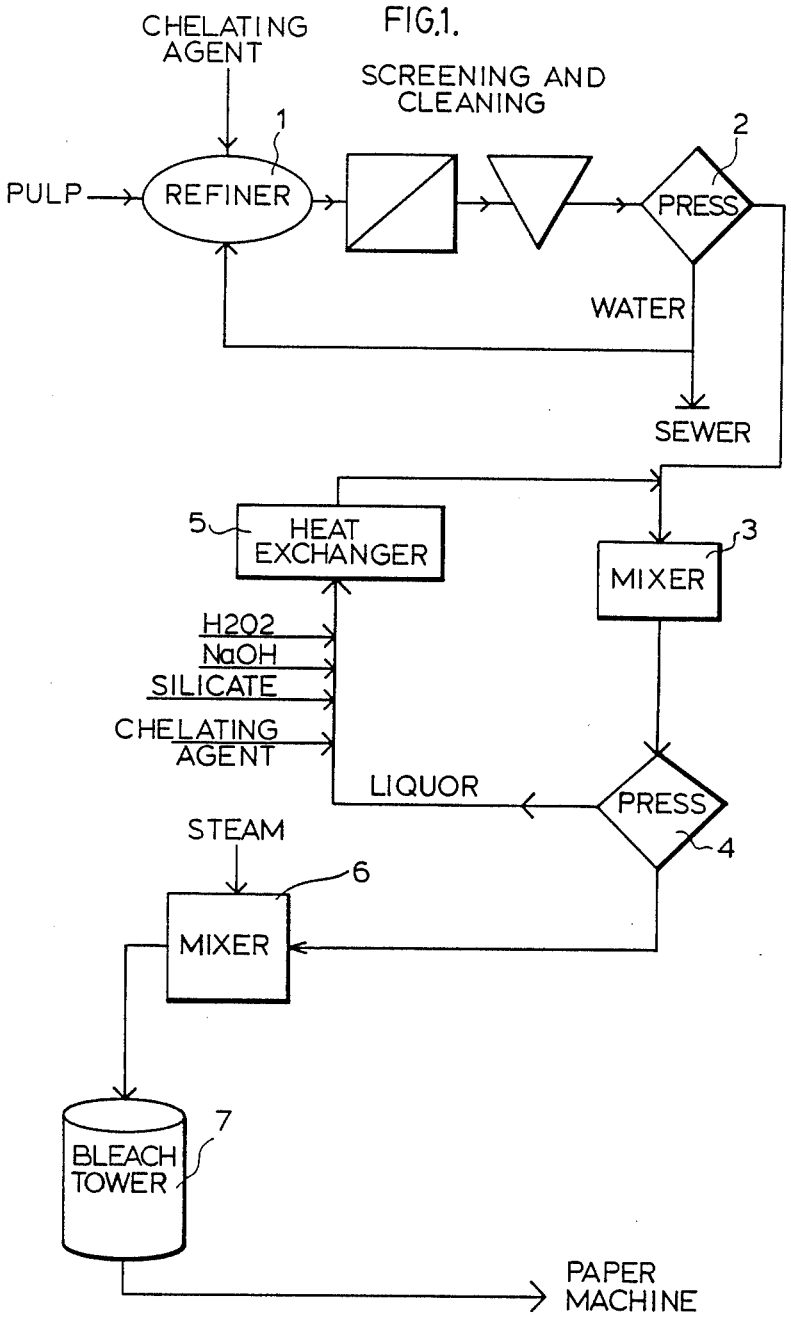
FIG. 1 is a schematic flow sheet of embodiments of the process of the invention.

With reference now to the flowsheet of FIG. 1, a wood pulp to be brightened may be subjected to a preliminary treatment for the removal of heavy metals such as iron, copper and manganese if present in the pulp. It is desirable for stabilizing the bleaching agent in the subsequent bleaching operation that heavy metals typified by manganese be removed down to less than 10 parts per million (ppm) manganese. Step 1 can thus be effected as a preliminary treatment in which the wood pulp to be bleached can be diluted to a consistency in the range of 1 to 10% and sufficient chelating agent added to sequester essentially all chelatable heavy metal ions such as iron, copper and manganese in the pulp. The resulting pulp is then dewatered in Step 2 to a consistency of 20 to 70% for the removal of sufficient water originally contained in the pulp to reduce the manganese content to less than 5ppm.

The chelating agent may be a typical chelating agent such as diethylenetriaminepentaacetic acid (DTPA), ethylenediaminetetraacetic acid (EDTA), diethylenetriaminepenta(methylenephosphonic acid) (DTMPA) or the like suitable for sequestering the heavy metals typical in a wood pulp, particularly manganese.

The dewatered wood pulp or fresh wood pulp low in heavy metals is fed to mixing Step 3 in which a bleach liquor is introduced in adequate quantity for uniform mixing therewith at a low final diluted wood pulp consistency in the range of 1 to about 16%. The consistency of mixing in this diluted range must be such that excellent and uniform mixing is achieved and is attained by adding sufficient bleach liquor to reduce the wood pulp consistency from the initial high value of 20 to 70% consistency of a fresh wood pulp or thickened wood pulp from step 2 to the level of below about 16%.

A conventional stock pump can be used for mixing for consistencies in the range of 1 to 6% and a medium-consistency pump or mixer used for mixing for consistencies in the range of 6 to 16%. The bleach liquor contains the following by weight of the final diluted wood pulp or liquor, as indicated, in the consistency range of 1 to 16%:

Hydrogen Peroxide: This is typical of the active bleaching chemical and, although the description proceeds with reference to hydrogen peroxide, it will be understood that sodium peroxide can be substituted for hydrogen peroxide as a bleaching chemical. The recommended raw material concentration is 50% to minimize the addition of excess liquid to the system. The concentration in the liquor should not be allowed to exceed a level at which decomposition may occur (usually about 5% for hydrogen peroxide and about 10% for sodium peroxide).

Sodium Hydroxide: This chemical is used to increase the liquor pH to a desired pH range of 10 to 14. The amount used depends on the peroxide dosage, the amount of silicate used, the type of pulp, and the bleaching temperature, among other factors. The sodium hydroxide charge must be optimized for each system, (usually in the range of from 0.5 to 6% based on pulp). A 50% sodium hydroxide solution should be used for re-fortification of recycled liquor solution to minimize the addition of excess liquid to the system.

Sodium Silicate: This chemical is used as a bleaching aid and as a stabilizer in conventional bleaching. The usual product is 41.6 Bé and contains 8.9% $Na_2O$ and 28.7% $SiO_2$. This formulation is not critical and other silicate products may be used. The silicate dosage on pulp is usually from 0.1 to 5% based on pulp.

Magnesium Sulphate: This chemical is used as a peroxide stabilizer. It is added to the liquor to give a concentration of 0 to about 1%, preferably about 0.02 to 0.05% in the liquor. It is usually added as a 1% solution although the concentration is not critical.

Chelating Agent: A chelating agent should be added to help improve the peroxide stability in the liquor. From 0 to 0.5%, based on the liquor, is added. Many commercial products have been successfully tried, DTPA, DTMPA, Monsanto's DEQUEST TM and Erco's BRIQUEST TM being typical.

It is an important aspect of the present invention that the mixing of bleach liquor with the wood pulp at reduced consistency be carried out at a low temperature in the range of from the freezing point of the bleach liquor, usually about 0° C., to about 25° C., a minimum temperature being preferred to minimize hydrogen peroxide decomposition and to minimize hydrogen peroxide consumption by the wood pulp.

Upon completion of mixing in Step 3, it is desirable that thickening of the wood pulp be effected as soon as possible to the desired bleaching consistency of about 20 to 70%, higher consistencies being preferred for reasons which will become apparent as the description proceeds. Thickening of the wood pulp within one minute is preferred, although delayed thickening may be permitted if the wood pulp is close to 0° C. Thickening in step 4 may be accomplished quickly with a conventional screw press, twin-wire press, twin-roll press, French Oil Press TM, or the like apparatus.

The expelled liquor from Step 4 is re-fortified with chemicals, to replace those exiting with the thickened wood pulp, in a preferred sequence of chemical addition of chelating agent, sodium silicate, magnesium sulphate, sodium hydroxide and hydrogen peroxide, and then cooled in a heat exchanger or other cooling apparatus 5 prior to recycling to mixing step 3.

The thickened wood pulp is then heated in step 6 during further mixing with steam and bleached in step 7 at a consistency in the range of about 20 to 70% at a temperature in the range of 10 to 95° C. for 24 hours to 1 minute, depending on the temperature. Lower temperatures are desirable but the attendant long retention times are usually unacceptable. A temperature in the range of 50 to 80° C. for a retention time of 4 to 1 hours thus is preferred, the actual temperature-time relationship being determined by the characteristics of each wood pulp.

The process of the invention will be further described by reference to the following examples.

EXAMPLE 1

The process of the invention as conducted on a laboratory scale at various bleaching consistencies of from 1 to 50% included the following steps which are representative of bleaching at 50% consistency with 2.5% peroxide:

(a) 15 g. of pulp were mixed with 0.075 g. DTPA to chelate metal ions at 1% consistency;

(b) the pulp was thickened to 20% consistency (total weight=75 g.) to remove metal ions;

(c) 682.5 ml of distilled water and 742.5 ml of bleach liquor were added to the pulp, to return the consistency to 1%, and the diluted pulp mixed with a lightning rod stirrer for 30 seconds at room temperature. The bleach liquor consisted of 100 g. of 50% hydrogen peroxide, 100 g. of 41.6° Bé sodium silicate, 39.52 g. of sodium hydroxide and 100 mL of 1% magnesium sulphate added to 1L of distilled water;

(d) the mixture was drained on a Buchner funnel to about 20% consistency;

(e) the pulp mat was pressed between rollers to a consistency of 50%;

(f) the pulp was sealed in a plastic bag and held at 50° C. for 2h;

(g) the pulp was diluted to 1% consistency with distilled water and the pH was adjusted to 5.5 with aqueous sulphur dioxide;

(h) the brightness of the pulp was measured using the standard brightness pad technique.

Figure 2:
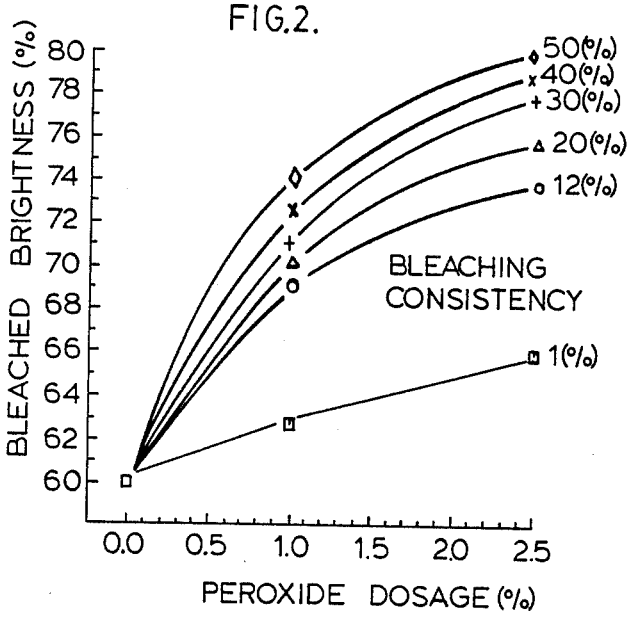
FIG. 2 is a graph illustrating brightness gains for various bleaching consistencies according to the process of the invention.

The final bleached brightness at 50% consistency was 80.1, as shown in FIG. 2. These results cannot be compared with bleaching at 50% consistency using conventional technology because it is impossible to mix liquor with pulp in the laboratory at consistencies above 25%. The improvement in brightness at increased pulp consistencies for all peroxide dosages is evident.

EXAMPLE 2

The process of the invention was conducted under the conditions set forth in Table 1 to demonstrate the effectiveness thereof for 1.0% and 2.5% hydrogen peroxide additions (% based on pulp).

TABLE 1

| | 1.0% $H_2O_2$ | 2.5% $H_2O_2$ |
|---|---|---|
| Silicate (%) | 5.0 | 5.0 |
| Total Alkalinity (%) | 1.5 | 2.5 |
| $MgSO_4$ (%) | 0.05 | 0.05 |
| Mixing Temperature (°C.) | 20 | 20 |
| bleaching Temperature (°C.) | 50 | 50 |
| Retention Time (h) | 2 | 2 |

Figure 3:
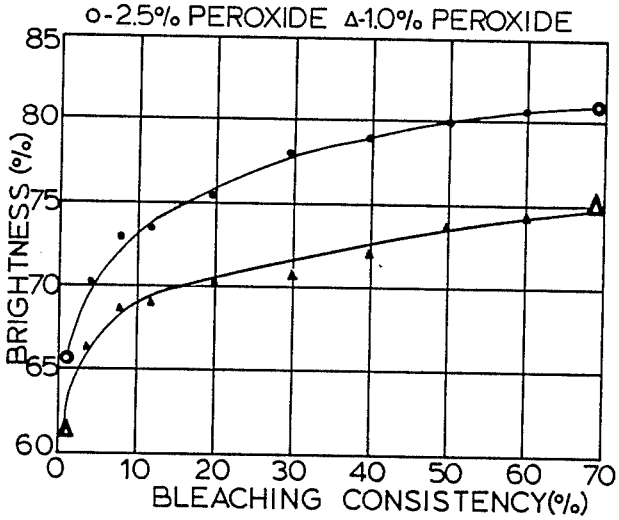
FIG. 3 is a graph illustrating the effect of bleaching consistency (up to 70%) on brightness for two peroxide dosages according to the process of the invention.
Figure 4:
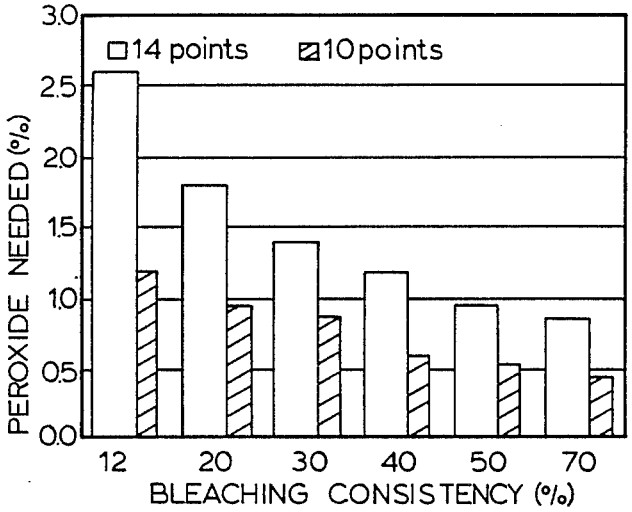
FIG. 4 is a bar chart showing the dosage of peroxide required to achieve two specific brightness gains, for one type of pulp, at different bleaching consistencies according to the process of the invention.

It will be noted from FIG. 3 that as the consistency is increased from 20% to 50% for 2.5% peroxide, the bleached brightness increases from 76 to 80 which is a larger benefit than might be predicted by extrapolation from data obtained using conventional processes. At 20% consistency, 2.5% peroxide gives a bleached brightness of about 75. At 50% consistency, this level of brightness would be achieved using about 1.25% peroxide; resulting in a 50% reduction in chemical consumption which is substantially greater than that anticipated. The results are even more impressive when the reduction in peroxide consumption is examined, as shown in FIG. 4.

EXAMPLE 3

This example illustrates the effectiveness of the process of the invention with 1% and 2.5% peroxide at 50% consistency compared to conventional laboratory-scale bleaching with 2.5% peroxide at 12% consistency. The tests were conducted under the conditions shown in Table 2.

TABLE 2

| | Conventional Bleaching (12%) | Process of the Invention (50%) | |
|---|---|---|---|
| Consistency (%) | 12 | 50 | 50 |
| $H_2O_2$ (%) | 2.5 | 2.5 | 1.0 |
| Silicate (%) | 5.0 | 5.0 | 5.0 |
| Total Alkalinity (%) | 2.5 | 2.5 | 1.5 |
| $MgSO_4$ (%) | 0.05 | 0.05 | 0.05 |
| Mixing Temperature (°C.) | 20 | 20 | 20 |
| Bleach Temperature (°C.) | 50 | 50 | 50 |
| Retention Time (h) | 2 | 2 | 2 |

Figure 5:
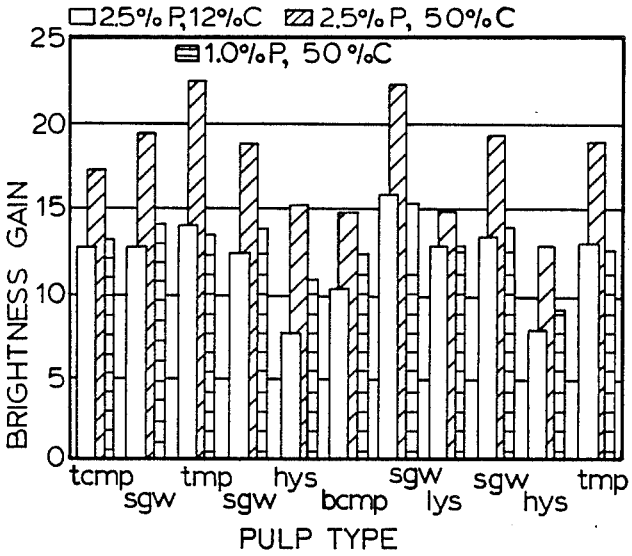
FIG. 5 is a graph illustrating brightness gains for eleven different wood pulps at different wood pulp consistencies and different peroxide dosages according to the process of the invention.

FIG. 5 illustrates the results of the tests for bleaching 11 different pulps, which are identified as follows:

TCMP ; Thermochemimechanical Pulp
SGW: Stove Groundwood
TMP: Thermomechanical Pulp
HYS: High Yield Sulfite
BCMP: Bisulfite Chemimechanical Pulp
LYS: Low Yield Sulfite The left columns show conventional laboratory bleaching results at 12% consistency using 2.5% peroxide. The centre columns show 50% consistency, using the present invention, at 2.5% peroxide; while the right columns show 1% peroxide at 50% consistency. In 8 cases a higher brightness was achieved with 1% peroxide (50% consistency) than with 2.5% peroxide (12% consistency); a chemical savings of 60%. In the other 3 cases the savings were less, at about 50%.

EXAMPLE 4

A pilot plant was set up to test the process as described with reference to FIG. 1 on a continuous basis. Three different types of pulp were bleached under the conditions shown in Table 3. Each pulp type was bleached in the laboratory at 12% consistency, in the laboratory at 35% consistency using the process of the present invention, and in the pilot plant at 35% consistency using the process of the present invention.

TABLE 3

| | Laboratory | Laboratory | Pilot Plant |
|---|---|---|---|
| Consistency (%) | 12 | 35 | 35 |
| $H_2O_2$ (%) | 2.5 | 2.5 | 2.5 |
| Silicate (%) | 5.0 | 5.0 | 5.0 |
| $MgSO_4$ (%) | 0.05 | 0.05 | 0.05 |
| BRIQUEST TM | 0.025 | 0.025 | 0.025 |
| Mixing Temperature (°C.) | 20 | 20 | 22 |
| Bleach Temperature (°C.) | 50 | 50 | 50 |
| Retention Time (h) | 2 | 2 | 2 |

Figure 6:
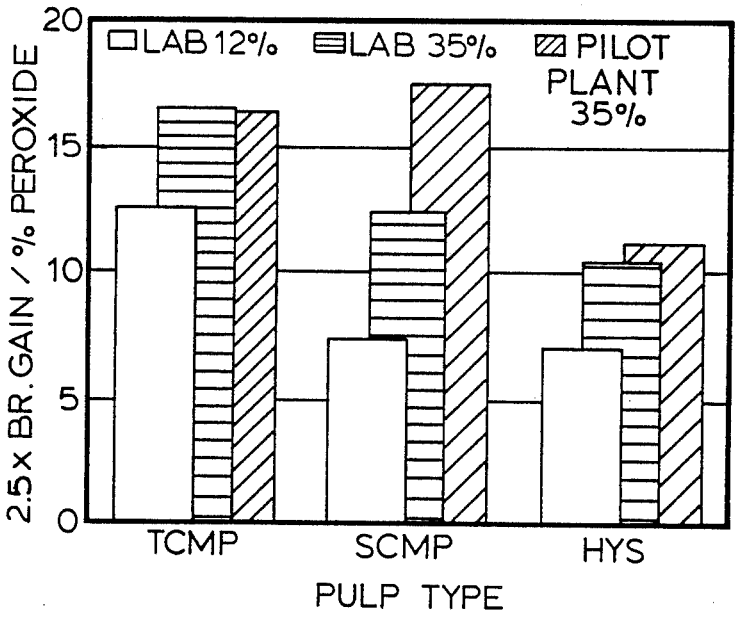
FIG. 6 is a graph illustrating the normalized brightness gains achieved in pilot plant trials compared to laboratory trials, according to the process of the invention.

The data, shown in FIG. 6, show normalized brightnesses because in the pilot plant it was impossible to control the peroxide dosage to exactly the required value. Thus, the dosage was measured after the trial and the brightness gains adjusted by dividing by the peroxide dosage.

These results confirm the higher brightness gains achievable using the process of the invention and show that continuous efficient operation of the system is possible given the following conditions.

(i) a chelating agent should be added to the bleach liquor to prevent decomposition of peroxide, which lowers bleaching efficiency. In cases where extremely good washing of the pulp is carried out prior to liquor addition, this would not be needed;

(ii) the temperature of the bleach liquor must be kept as low as possible t minimize peroxide decomposition and consumption during the mixing phase;

(iii) the mixing and thickening processes should not result in significant heating of the pulp or liquor; and (iv) the time between liquor addition to the pulp, and subsequent thickening of the pulp, should be kept as short as possible. Likewise the time required for liquor recirculation in the re-fortification step should be as short as possible.

EXAMPLE 5

High yield sulfite (HYS) pulp is very difficult to bleach with peroxide. Comparative tests were conducted at 12% and 50% consistencies under the conditions shown in Table 4.

TABLE 4

| | Consistency | |
|---|---|---|
| | 12% | 50% |
| $H_2O_2$ (%) | 2.5 | 2.5 |
| Silicate (%) | 5.0 | 5.0 |
| Total Alkalinity (%) | 2.5 | 2.5 |
| $MgSO_4$ (%) | 0.05 | 0.05 |
| Mixing Temperature (°C.) | 20 | 20 |
| Bleaching Temperature (°C.) | 50 | 50 |
| Retention Time (h) | 2 | 2 |

Table 5 shows bleaching results for a HYS pulp at different consistencies.

TABLE 5

| Consistency | % Peroxide for 4 point gain | % Peroxide 6 point gain |
|---|---|---|
| 12% | 1.5 | 2.5 |
| 50% | 0.4 | 0.5 |

The reduction in bleaching cost for a 6 point gain is thus 80%. It is not possible to determine cost savings above 6 points gain since at low consistency 6 points was about the maximum brightness gain while 12 points was the maximum for 50% consistency.

In addition to brightness gains, bleaching at high consistencies surprisingly provided additional strength to the product. An average increase of 18% was found when HYS was bleached at 50% consistency, as shown in Table 6.

TABLE 6

| | Unbleached | Conventional Bleaching (12%) | Process of the Invention (50%) |
|---|---|---|---|
| Density | 0.447 | 0.503 | 0.529 |
| Burst Index | 4.3 | 4.6 | 5.1 |
| Tear Index | 7.88 | 7.88 | 7.87 |
| Tensile Stress | 41.1 | 42.4 | 47.5 |
| Tensile Strain | 2.30 | 2.44 | 2.61 |
| Breaking Length | 6770. | 7439. | 7990. |
| Wet Stretch | 2.73 | 2.98 | 3.36 |
| Wet Load | 1.26 | 1.41 | 1.52 |
| Freeness | 402. | 406. | 352. |

EXAMPLE 6

Softwood stone groundwood pulp is difficult to bleach to 80 brightness at reasonable peroxide dosages; usually 5% or more peroxide is required. Tests were conducted according to the conditions of Example 2 and the improved results from bleaching a sample of black spruce with the process of the invention and with conventional technology are shown in Table 7.

TABLE 7

| Peroxide Dosage | Conventional Bleaching (20% Cons.) | Process of the Invention (50% Cons.) |
|---|---|---|
| 1.0% | 70.8 | 74.5 |
| 2.5% | 75.7 | 80.1 |

EXAMPLE 7

It has been found that bleaching up to 70% consistency is possible with the process of the invention. A sample of SGW pulp was bleached using the process of the invention according to the conditions of Example 2 and the results are presented in Table 8.

TABLE 8

| Bleaching Consistency | Bleached Brightness | |
|---|---|---|
| | 1% $H_2O_2$ | 2.5% $H_2O_2$ |
| 20 | 73.0 | 79.6 |
| 40 | 75.6 | 80.7 |
| 50 | 75.6 | 82.2 |
| 60 | 77.8 | 82.2 |
| 70 | 78.8 | 82.4 |

Increasing the consistency above 50% was found beneficial, especially at the low peroxide dosages. It is also to be noted that the use of the process of the invention at a fairly low consistency (20%) gave better results than conventional bleaching at 20% consistency, as indicated by a comparison of Tables 3 and 4 at 20% consistency.

It will be understood, of course, that modifications can be made in the embodiments of the invention illustrated and described herein without departing from the scope and purview of the invention as defined by the appended claims.

We claim:

1. A single stage bleaching process for bleaching wood pulp which comprises, in combination, the steps of adding to the wood pulp a bleach liquor having an effective amount of hydrogen or sodium peroxide bleaching agent and 0.5 to 65% sodium hydroxide, 0 to 5% sodium silicate, 0 to 1% magnesium sulphate, and a chelating agent in an amount sufficient to sequester heavy metal ions, to produce a pulp consistency of 1 to 16% at a temperature in the range of the bleach liquor freezing point to 25° C., uniformly mixing the bleach liquor with the wood pulp, passing said wood pulp and bleach liquor directly to a thickening stage and thickening the wood pulp and bleach liquor to a consistency in the range of 20 to 70%, and bleaching the thickened wood pulp.

2. A process as claimed in claim 1 in which said wood pulp is subjected to a preliminary treatment by the addition of a chelating agent in an amount sufficient to sequester chelatable heavy metals including manganese at a pulp consistency of 1 to 10%, and dewatering said pulp to a consistency of 20 to 70% to remove the sequestered manganese to less than 10 ppm.

3. A process as claimed in claim 2 in which said hydrogen peroxide is present in an amount of from about 1 to 5% by weight and said sodium peroxide is present in an amount of from about 2 to 10% by weight of the diluted wood.

4. A process as claimed in claim 3 in which said magnesium sulphate is added in an amount of 0.02 to 0.05% by weight of the diluted wood pulp.

5. A process as claimed in claim 3 in which said chelating agent is added in an amount up to 0.5% by weight of the diluted wood pulp.

6. A process as claimed in claim 3 in which chelating agent is selected from the group consisting of DTPA, EDTA, DTMPA, and the chemical equivalent.

7. A process as claimed in claim 1 in which the liquor produced by thickening of the diluted wood pulp is cooled and recycled for addition to fresh wood pulp.

8. A process as claimed in claim 3 in which the thickened wood pulp is bleached at a temperature in the range of 10° C. to 95° C. for a time sufficient to achieve the desired brightness.

9. A process as claimed in claim 3 in which the thickened wood pulp is bleached at a temperature in the range of about 50° to 80° C. for a time in the range of 4 to 1 hours.

10. A process as claimed in claim 3 in which the liquor produced by thickening of the diluted wood pulp is re-fortified with chemicals in the addition sequence of chelating agent, sodium silicate, magnesium sulphate, sodium hydroxide and hydrogen peroxide, and cooled to a temperature in the range of the freezing point of the liquor to 25° C.

11. A process as claimed in claim 3 in which the liquor produced by thickening of the diluted wood pulp is re-fortified with a chelating agent in an amount sufficient to stabilize the hydrogen peroxide and cooled to a temperature near the freezing point of the liquor.

* * * * *

UNITED STATES PATENT AND TRADEMARK OFFICE

CERTIFICATE OF CORRECTION

PATENT NO. : 4,938,842

DATED : July 3, 1990

INVENTOR(S) : Philip Whiting, et al

It is certified that error appears in the above-identified patent and that said Letters Patent is hereby corrected as shown below:

Col. 8, claim 1, line 5, change "65%" to --6%--

Signed and Sealed this

Fifth Day of November, 1991

*Attest:*

HARRY F. MANBECK, JR.

*Attesting Officer*

*Commissioner of Patents and Trademarks*